United States Patent [19]

Garner

[11] 4,140,189

[45] Feb. 20, 1979

[54] ROCK BIT WITH DIAMOND REAMER TO MAINTAIN GAGE

[75] Inventor: Lloyd L. Garner, San Clemente, Calif.

[73] Assignee: Smith International, Inc., Irvine, Calif.

[21] Appl. No.: 803,845

[22] Filed: Jun. 6, 1977

[51] Int. Cl.[2] ..... E21B 9/36

[52] U.S. Cl. ..... 175/329; 175/374; 175/410

[58] Field of Search ..... 175/329, 330, 374, 410; 76/101 R, DIG. 12, 108 A

[56] References Cited

U.S. PATENT DOCUMENTS

| | | | |
|---|---|---|---|
| 2,182,562 | 12/1939 | Koebel | 175/410 X |
| 2,419,901 | 4/1947 | Lake | 175/330 |
| 2,708,104 | 5/1955 | McAllister | 175/330 X |
| 3,130,801 | 4/1964 | Schumacher, Jr. | 175/374 |
| 3,134,447 | 5/1964 | McElya | 175/374 X |
| 3,344,870 | 10/1967 | Morris | 175/374 X |
| 3,513,728 | 5/1970 | Hudson et al. | 125/39 |
| 3,628,616 | 12/1971 | Neilson | 175/410 X |
| 3,745,623 | 7/1973 | Wentorf, Jr. et al. | 76/101 A X |
| 4,006,788 | 2/1977 | Garner | 175/336 X |

*Primary Examiner*—Stephen J. Novosad
*Assistant Examiner*—Richard E. Favreau
*Attorney, Agent, or Firm*—Christie, Parker & Hale

[57] ABSTRACT

A rock drill bit comprises a bit body and at least one rolling cone cutter mounted on the bit body, the rolling cone cutter comprising a plurality of tungsten carbide inserts including a plurality of gage inserts for drilling adjacent the peripheral wall of the hole being drilled. At least one diamond cutter protrudes from the bit body to provide a cutting edge substantially on the gage diameter of the rock bit so that such a diamond insert can engage the peripheral wall of the hole being drilled, thereby maintaining the hole gage. Each diamond cutter comprises a carbide slug inserted in the bit body and a diamond plate bonded to the slug. Such diamond cutters are on a peripheral portion of the bit body above the cutter cones.

11 Claims, 3 Drawing Figures

12
86
54
3°
52
5°
26
74
70
84
70
24
72
25
51
50
56
40
11
15
16
17
18
23
14
20
25
51
22
28
65
23
21
15
50
56
40
30
66

ROCK BIT WITH DIAMOND REAMER TO MAINTAIN GAGE

BACKGROUND

Two principal types of rotary drill bits are employed for rock drilling for oil wells, recovering core samples, and the like. One type of rotary rock drill is a drag bit. Some of these have steel or hard faced teeth, but primarily they are set diamond drills such as described in U.S. Pat. No. 3,174,564. Typically in a set diamond drill the face is coated over much of its area with a hard material in which are embedded or "set" numerous diamonds. The diamonds protrude from the surface of the matrix and when the drill is used they rub on the rock, abrading shallow tracks and cutting primarily by a combination of compressive and shearing action. Good flow of drilling mud adjacent such set diamonds is important for cooling to prevent damage to the diamonds from overheating.

Another type of bit, described below in greater detail, uses rolling cone cutters mounted on the body of the drill bit so as to rotate as the drill bit is rotated. Combinations of drag bits and rolling cone bits have been proposed. For example, U.S. Pat. No. 3,174,564 to E. A. Morlan for a "Combination Core Bit", has a cylindrical crown encrusted with set diamonds for cutting an annulus around a core. The set diamonds protrude from the matrix tiny distances in the conventional manner. A plurality of rolling cone cutters with carbide inserts are mounted in special recesses around the cylindrical crown for cutting an outer annulus of considerably greater area than the inner annulus cut by the diamonds. Also, U.S. Pat. No. 1,506,119 describes a combination rotary cutting/diamond bit.

Recently a new product has become available that permits a new type of rock bit. The product is a diamond cutter described in greater detail hereinafter. Broadly, the diamond cutter has a wafer or plate of diamond about 0.020 inch thick and about 0.520 inch in diameter bonded to a tungsten carbide slug. This product was developed by General Electric and is commercially available under their trademark COMPAX or STRATAPAC. Such diamond cutters are available with a circular 0.520 inch diameter diamond wafer or with half of such a wafer as a semicircle.

The carbide slug can be inserted in a drill bit body so that the diamond plate protrudes therefrom at the proper angle for cutting rock. The cutting action by these diamond cutters is by shearing the rock much in the manner of conventional machining with cutting tools rather than the grinding-like action of conventional set diamond drills. Instead of finely ground material, much of the cut rock emerges from the drilled hole as appreciable size chips, somewhat like these from a rolling cone cutter. A rock drill having such diamond cutters protruding from its face has been built by General Electric.

A rock bit having such diamond cutters and rolling cone cutters is described in my U.S. patent application Ser. No. 585,975, filed June 11, 1975, now U.S. Pat. No. 4,006,788. This application is incorporated herein by this reference.

The use of rolling cone cutters in drilling rock is a well-known and long-established art. A typical rock bit includes three rolling cutters, each having a generally conical configuration, and each occupying much of a separate 120° sector above the bottom of the well bore.

Each cone is equipped with a number of generally circular rows of inserts or cutting elements. Some cones have hardened steel teeth integral with the cone. Many cones have tungsten carbide inserts or other hard material forming the cutting elements. As the cone rotates, the work surface of the inserts of each row are applied sequentially in a circular path upon the bottom of the hole in the rock that is being drilled. As the rolling cone cutters roll on the bottom of the hole being drilled, the teeth or carbide inserts apply a high compressive load to the rock and fracture it. The cutting action in rolling cone cutters is typically by a combination of crushing and chipping.

There are several distinct shapes of tungsten carbide inserts which are standard in the industry for rolling cone cutters, such as the conical, the double cone, the semiprojectile, and the chisel crest. All of these insert shapes, however, are generally characterized in that they comprise a cylindrical base for mounting in a rolling cone cutter and an end converging to a work surface. The work surfaces are blunt-pointed with a somewhat wedge-shaped configuration, meaning that the first engagement with the surface of the rock is but a relatively small surface area, but when indentation into the surface of the rock has progressed, the width or thickness of the cutting element which then comes into contact with the rock is greater.

In operation, a rolling cone drill bit is attached to the lower end of a drill stem or drill string, and rotated about the longitudinal axis of the drill bit on the bottom of a bore hole. Thus, the rolling cone cutters are caused to rotate, and as weight is applied to the bit by the weight of the drill string, the tungsten carbide inserts of the cones crush, chip, gouge, and scrape the formation upon which the bit is rotated depending on the presence or absence of skew of the cone axis. The particles of rock formation thus dislodged are carried out of the bore hole by drilling fluid such as drilling mud which is pumped downwardly through the drill stem and rock bit, returning to the surface of the earth via the annular space between the drill string and the wall of the bore hole being drilled.

The tungsten carbide inserts along the periphery of a bit, that is, nearest the base of the cones, and which define the diameter of a hole being drilled are known as gage inserts. As the rolling cone cutters rotate, the gage inserts scrape against rock at the periphery of the hole being drilled to dislodge rock formation by compression and gouging. Of all the inserts of a rolling cone cutter, the gage inserts are most susceptible to wear because they undergo both abrasion and compression as they scrape against the periphery of a bore hole. Any appreciable amount of wear on the gage inserts is undesirable because this could result in an undersized bore hole. When a replacement drill bit is inserted toward the bottom of an undersize bore hole, the replacement bit can pinch against the undersized portion of the hole and experience undue gage surface and bearing wear in reaming the undergage hole, thereby compounding the problem.

Rock bits are often made with the nominal gage diameter being the smallest acceptable size and an overgage tolerance of about 1/32 to 3/64 inch. Thus, for example, a nominal 7⅞ inch bit has a minimum gage diameter at the gage inserts of 7.875 inch and a maximum gage diameter of about 7 29/32 inch.

Excessive wear on gage inserts can occur even though gage inserts generally are made of tungsten carbide, either by itself or combined with other materials such as cobalt. The gage row inserts are subjected to compressive loads like the other inserts in the cone. They are also subjected to abrasion by rubbing on the hole wall. Therefore, the gage cutting elements tend to wear faster than other cutting elements, and thereby can be a limiting factor on the life of a drill bit. Excessive wear due to abrasion on the gage cutting elements can necessitate premature replacement of the drill bit. Replacement is a time-consuming and expensive process, especially in deep bore holes, since the entire drill string must be removed from the hole in order to change the bit. Also, gage tungsten carbide inserts in a rolling cone cutter can exhibit poor wear resistance when drilling through formations containing steam or hot water containing corrosive salts such as when drilling for sources of geothermal energy.

Therefore, there is a need for a drill bit which avoids the drilling of undergage bore holes, including when the drill bit is used to drill for sources of geothermal energy.

SUMMARY OF THE INVENTION

The present invention concerns rock drill bits exhibiting such features. Such a rock bit comprises a bit body having a longitudinal axis of rotation and at least one rolling cone cutter mounted on the bit body for rotation upon rotation of the bit body. Each such rolling cone cutter comprises a plurality of tungsten carbide inserts protruding from the surface of the cutter, and including a plurality of gage inserts for drilling adjacent the peripheral wall of the hole being drilled. At least one diamond cutter protrudes from a peripheral portion of the bit body above the cutter cones. Each such diamond cutter protrudes from the bit body in the radial direction relative to the axis of rotation of the bit body and has a cutting edge for engaging the peripheral wall of the hole being drilled at a diameter substantially the same as the gage diameter of the rock bit. Thus, if the gage inserts become worn under gage, the diamond cutters serve to ream the hole wall, thereby preventing the hole from becoming undergage.

Each diamond cutter comprises a carbide slug inserted in the bit body and a diamond plate bonded to the slug. The diamond plate can be circular or semi-circular. The diamond plate faces in a circumferential direction relative to the longitudinal axis of rotation of the bit body for providing a cutting edge to engage rock on the hole wall upon rotation of the bit body.

DRAWINGS

These and other features, aspects and advantages of the present invention will become more apparent upon consideration of the following description, appended claims and accompanying drawings wherein:

DESCRIPTION OF THE INVENTION

Figure 1:
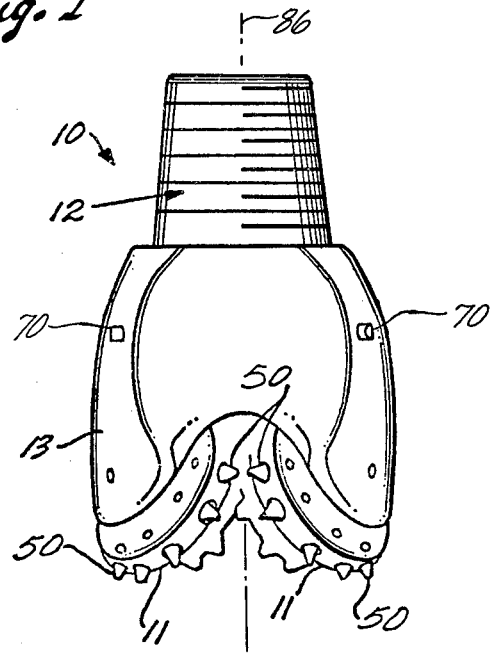
FIG. 1 is a pictorial view of a rock bit having three rolling cone cutters mounted thereon in accordance with principles of this invention.
Figure 2:
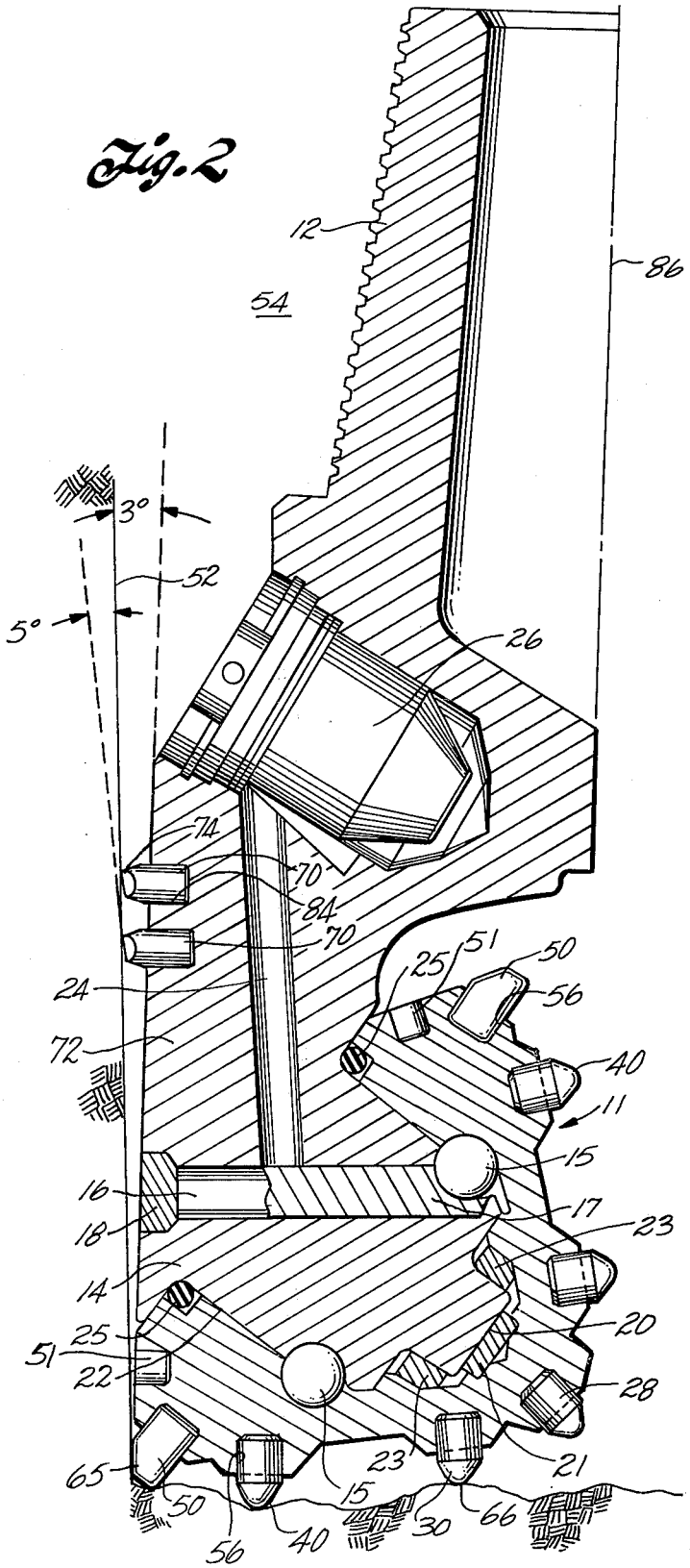
FIG. 2 is a semi-schematic, longitudinal, cross-sectional view through one leg and rolling cone cutter of the rock bit of FIG. 1.

FIG. 1 illustrates a side view of a rock drill bit 10 having three conical rollers 11. FIG. 2 illustrates in longitudinal cross section the mounting of one of the rollers 11. The conical roller 11 may also be referred to as a cone, a rolling cone cutter, or as a roller cutter. The bit has a heavy duty steel body with a threaded pin joint 12 at its upper end. The main body of the bit is formed by welding together three steel legs 13, each terminating in a conventional journal 14 on which the respective cutter cone 11 is mounted. FIG. 2 is a longitudinal cross section through one such leg. In use, the drill bit rotates about its longitudinal axis 86 with the cones at the lower end and the upper end connected to a drill string. As used herein, upper and lower refer to locations with respect to the position of a bit when drilling.

When the drill bit is assembled ball bearings 15 are added through a ball passage 16 from the exterior of the leg to a ball bearing race on the pin, which is then closed with a ball retainer 17 which retains the balls in place. Typically, the ball retainer is welded in place with a ball plug 18. The ball bearings 15 may carry some radial or thrust load between the journal and the cone, but a primary function of the balls is to lock the cone on the journal. A nose bearing 20 on the journal engages a thrust button 21 in the cone for carrying the principal thrust loads of the bearing structure. The brunt of the radial loads between the cone and journal is carried by the main cylindrical bearing surfaces 22 and bushing 23. The solid journal bearings and ball bearings are lubricated by grease flowing through a lubricant passage 24. This grease is retained by an O-ring or similar sealing element 25. The lubricant passage receives lubricant from a lubricant reservoir 26 containing a conventional pressure compensator.

Referring to FIG. 2, on the nose of the cone 11 there is mounted a single insert 28, which in the particular illustration is a tungsten carbide insert whose forward or cutting end portion is of the conical type. A first circular row of tungsten carbide inserts 30 is mounted near the forward end of the cone 11, while an additional row of interior tungsten carbide inserts 40 is mounted on the cone 11 towards the rearward or base portion thereof. Each rolling cone cutter also has an outermost row of carbide inserts 50, generally referred to as the gage row. The inserts in the outermost row are at the periphery of the hole being drilled and maintain its full gage. As the cone rolls during drilling, each gage insert 50 engages both the bottom and the peripheral wall 52 of the bore hole 54 formed by the drill bit in the rock formation. The spacing of the inserts within the rows 30, 40, and 50 on individual rolling cone cutters may be varied in a conventional manner to minimize tracking and maximize cutting efficiency. A row of heel inserts 51 is also provided on the heel of each cutter to provide abrasion resistance and help maintain gage of the rock bit. The heel inserts 51 can engage the wall of the hole being drilled although they are usually at a slightly smaller diameter than the gage inserts 50.

The tungsten carbide inserts are mounted in the cones in mounting recesses 56. The diameter of each tungsten carbide insert is typically larger than the diameter of the recess in which it is mounted. Each tungsten carbide insert is forced into its recess and held in place by a press fit between it and the steel wall of the recess. Typically, the interference between the tungsten carbide insert elements and the wall of the recess is about 0.003 inch.

All of the interior tungsten carbide inserts 28, 30, 40, shown in FIG. 2 are of the conical type. The gage row tungsten carbide inserts 50 are of the chisel crest type, where the chisel crest is skewed toward the side 65 of the insert which engages the peripheral wall 52 of a bore hole 54 during drilling. However, the outermost end 66 of the inserts can have any of a variety of shapes such as semi-projectile, double cone, or other shapes known to the art.

During drilling the gage inserts can wear, thereby resulting in an undergage bore hole with the attendant problems described above. According to the present invention, there is provided at least one diamond cutter 70 having a cutting edge for engaging the peripheral wall 52 of the bore hole 54 to maintain gage of the hole. Such diamond inserts protrude approximately radially from a peripheral portion of the bit body and are mounted on a portion of the bit body, above the cones and downhole from the lubricant reservoirs 26. Each diamond cutter is oriented so a diamond plate 76 of the cutter faces in a circumferential direction relative to the longitudinal axis 86 of rotation of the bit body to engage the peripheral wall of the hole being drilled during rotation of the bit body for providing a cutting edge for engaging rock on the hole wall.

Each diamond cutter protrudes from the bit body a distance which places the cutting edge at the gage diameter of the rock bit. Preferably the cutting edge is on the gage diameter or only slightly over gage. The gage row inserts on the cutter cones are on gage or over gage by up to 1/32 or 3/64 inch. Thus, when unworn gage cutting inserts on the cones are cutting slightly over gage, the farthest protruding edge 74 of the diamond cutters 70 is spaced apart from the peripheral wall 52 by a small distance.

The diamond cutters placed on a peripheral portion of the bit body so as to ream the hole wall are quite resistant to wear. The diamond cutters on the gage diameter ream the hole to gage for a substantial time after the carbide gage row inserts have worn under gage. Thus, it is desirable to place the cutting edge of the diamond inserts on the gage diameter. If the diamond inserts are significantly over gage, that is, extend beyond the gage diameter, damage to such a diamond insert can occur as the bit is lowered in a previously drilled hole. If the diamond cutters are under gage, an under gage hole can result with possible pinching or damage to diamond cutters on a subsequent bit run into the hole. Thus, it is preferred that the diamond cutters be located that the cutting edge cuts on the gage diameter or no more than a few thousandths of an inch over the gage diameter. The carbide gage row inserts are either on the gage diameter or extend beyond the nominal gage diameter by up to about 1/32 or 3/64 inch depending on the acceptable tolerance for the particular size of rock bit. The diamond cutters should protrude from the bit axis no more than the protrusion of the gage row inserts on the cutter cones.

Figure 3:
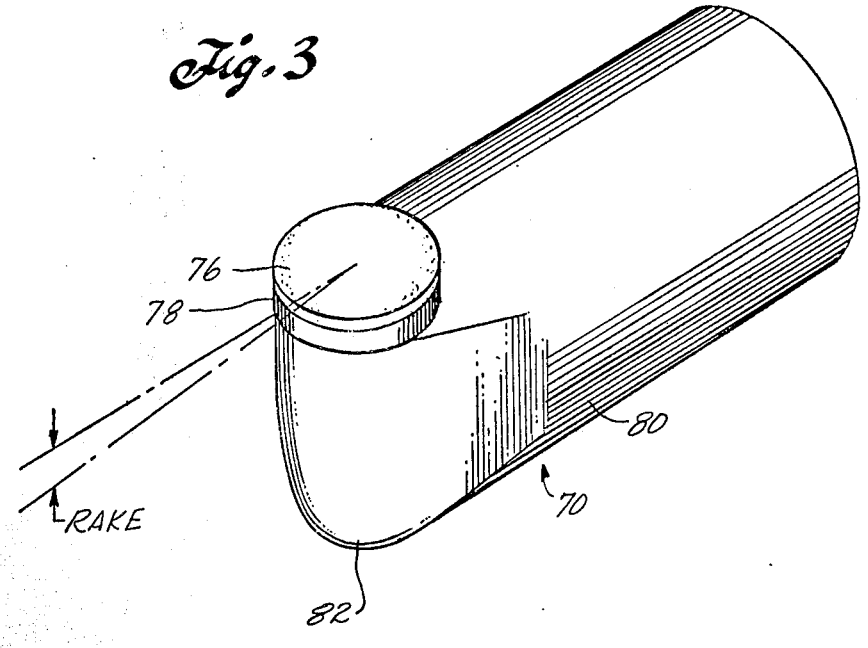
FIG. 3 is a perspective view of a diamond cutter.

FIG. 3 is a perspective view of one of the COMPAX or STRATAPAC diamond cutters 70 available from General Electric. The diamond is a circular plate 76 about 0.020 inch thick and about 0.52 inch diameter. The diamond cutters shown in FIG. 2 are similar and have a semi-circular plate 74 instead of the full circle. The diamond plate is not a single crystal diamond but is a diamond-to-diamond, bonded polycrystalline material. The diamond plate 76 is bonded to a short tungsten carbide cylinder 78 that is in turn brazed to a tungsten carbide slug 80. As one example, the carbide slug has a cylinder base about 0.628 inch diameter to give a tight press fit in a five-eighth inch diameter hole in the bit. Such a press fit is the sole mounting required for such a diamond cutter. The diamond plates bonded to a tungsten carbide cylinder are available and a variety of convenient slug geometries can be used for mounting the diamond cutter on the rock bit.

In the embodiment illustrated in FIG. 3, the short carbide cylinder 78 is supported on the slug 80 by a buttress-like portion 82 supporting the end of the carbide cylinder, except for a narrow rim about 0.01 inch wide around half the perimeter of the carbide cylinder. The rear portion of the buttress 82 which trails the diamond plate in use of the cutter has a relief behind the diamond plate formed to a radius which will clear the hole wall. This prevents portions of the carbide slug from interfering with cutting action by the diamond plate 76. The carbide cylinder 78 and hence the diamond plate 76 are tilted rearwardly (downwardly in FIG. 3) relative to the axis of the slug at an angle in the range of from aout 5° to 15° so that in use the rake angle or angle of attack of the diamond plate on the rock is about −5° to −15°. Rake angles from about 0° to about −30° appear to be suitable.

Each diamond cutter can be mounted on the bit body with the diamond plate essentially on a bit diameter. In this position relief behind the diamond plate is important to prevent contact of the tungsten carbide slug and the hole wall. The slug mounting the diamond plate can be located with its axis on a bit diameter and somewhat less relief is needed since the diamond plate is thereby offset from the diameter. Additional offset can be obtained by having the axis of the mounting slug offset from a bit diameter.

Diamond cutters are available with a semi-circular diamond plate where the carbide base 78 is semi-cylindrical. An advantage of using semi-circular diamond plates is that they are appreciably less expensive than circular diamond plates and there is little, if any, diminution of cutting efficiency.

Each diamond cutter is mounted in a flat bottomed hole 84 (FIG. 2) drilled in a peripheral portion of the bit body above the cones.

In the embodiment illustrated in FIG. 2 the diamond cutters are semi-circular and are mounted with the straight edge next to the hole wall. The straight edge is substantially aligned with the rotational axis of the rock bit. That is, the edge is generally parallel to the axis of the bit body although it may be skewed or tilted slightly from that orientation for better cutting action. Thus, the diamond cutters are mounted so that the straight edge is parallel to the hole wall or tilted somewhat so that the outermost end of the cutting edge is at the uphole end of the bit.

When the diamond cutter is mounted so that the edge is parallel to the hole wall, cutting action can extend along the full length of the straight edge so that wear does not bring the diamond reaming cutter under gage. Tilting the diamond cutter a small amount as illustrated in FIG. 2 can ease cutter positioning tolerance while still maintaining the diamond cutter on the nominal gage of the rock bit. Tilting the cutting edge can also distribute cutting action along much of the edge rather than concentrating it in a small area. This can have a beneficial effect on cooling of the diamond and prolonging its life.

A bit body can have more than one diamond cutter. When more than one diamond cutter is used, the diamond cutters can be staggered circumferentially around the bit body and/or staggered longitudinally up and down the bit body as shown in FIG. 2. The diamond cutter should be mounted in a portion of the drill bit where there is sufficient wall thickness to support the diamond cutter during drilling. Thus, although two diamond cutters are shown semi-schematically in FIG. 2 as being proximate to the lubricant reservoir 26 and on a single cross section of the bit body, the diamond cutters can be positioned circumferentially around the bit body to be away from the reservoir to maximize the bit body wall thickness available for support of the cutters.

IT is preferable to space diamond cutters circumferentially around the bit body so that there is no asymmetrical loading of the bit which could cause hole deviation. Thus, for example, in a three cone rock bit as described herein, three diamond cutters can be spaced circumferentially apart so that one is in each of the three sectors of the bit body. If additional cutters are added, they would be in integral multiples of the number of cones on the rock bit. Thus, in a three cone rock bit as illustrated herein, diamond cutters would be present in multiples of three.

Multiple diamond cutters can also be spaced longitudinally along the length of the bit body, if desired. It appears desirable, however, to place all the diamond cutters at the same longitudinal position so that all have an equal opportunity to ream the hole during operation of the rock bit. When a plurality of diamond cutters are mounted at various longitudinal positions along the length of the rock bit body, the up hole cutters can serve as "reserve" for cutting action after wear of the diamond cutters further down hole. Thus, a variety of patterns of diamond cutters spaced circumferentially and/or longitudinally on the rock bit body can be employed for reaming the hole wall above the cutter cones to maintain hole gage.

When a plurality of diamond cutters are used, each should have its cutting edge substantially on the nominal gage diameter of the bit as described above. In this way all of the diamond cutters are available for maintaining the gage of the bore hole regardless of wear of the gage row carbide inserts 50.

The diamond cutters are located on a peripheral portion of the rock bit body spaced up hole from the cutter cones. Location on a peripheral portion of the body assures engagement of the cutting edges with the wall of the hole at a portion of the wall above the bottom of the hole. Drilling of the hole is conducted with drilling mud or other drilling fluid passing down the drill string and up through the annulus between the drill string and the hole wall. This drilling fluid removes chips and also provides cooling for the cutting elements of the rock bit. The peripheral location of the diamond cutters on the rock bit body places them in the flow of drilling fluid so that there is good cooling to avoid damage to the diamonds.

When rock is drilled, the drill bit is run into a well bore on the lower end of a drill string and the cutter cones 11 engage the face of the rock on the bottom of the hole that is to be drilled. The drill is loaded with a suitable weight load, such as that conventionally applied by the drill string and drill collars. The drill bit is rotated inside the well bore by way of the drill string. As this rotation takes place, under load, the carbide inserts on the cones engage the face of the rock in sequence, thereby crushing and chipping away rock. As drilling continues, the gage inserts 50 can wear due to abrasion on the hole wall. If the gage inserts have worn below the nominal gage of the rock bit, the peripheral wall of the hole is engaged by the diamond cutters 70 protruding from the peripheral part of the bit body to maintain the gage of the hole being drilled. The diamond cutters maintain the gage of the hole by shearing or reaming rock from the peripheral wall of the hole thereby maintaining the gage of the hole.

In operation, due to the presence of the diamond cutters, longer life of the drill bit is realized. This is because diamond cutters are quite wear resistant and prevent the hole being drilled from becoming under gage even after the gage tungsten carbide inserts 50 on the cones have suffered excessive wear. The cost of the diamond cutters is more than offset by savings from reduced frequency of bit changes. This is particularly significant in drilling geothermal wells where high temperatures, corrosive fluids and air cooling (rather than drilling mud) are common.

Although this invention has been described in considerable detail with reference to certain versions thereof, there are other versions within the scope of this invention. For example, although the invention has been described in terms of circular and semicircular diamond plates, plates of other shape can be used. Because of variations such as this, the spirit and scope of the appended claims should not necessarily be limited to the description of the preferred versions contained herein.

What is claimed is:

1. A rock bit for drilling oil wells or the like comprising:

a bit body having a longitudinal axis of rotation;

at least one rolling cone cutter mounted on the bit body for rotation upon rotation of the bit body, each such rolling cutter comprising a plurality of tungsten carbide inserts protruding from the surface of the rolling cone cutter and including a plurality of gage inserts for engaging the bottom of a hole being drilled adjacent the peripheral wall of the hole; and at least one diamond cutter protruding from a peripheral portion of the bit body longitudinally spaced above such rolling cone cutters, each such diamond cutter comprising a carbide slug inserted in the bit body and a diamond plate bonded to the slug, the diamond plate facing in a circumferential direction relative to the longitudinal axis of rotation of the bit body for providing a cutting edge protruding from the bit body for engaging the peripheral wall of a hole being drilled at a location above the gage inserts and maintaining the gage of the hole upon rotation of the bit body.

2. A rock bit as recited in claim 1 wherein the diamond cutter is mounted with the cutting edge substantially on the gage diameter of the rock bit.

3. A rock bit as recited in claim 1 wherein a plurality of diamond cutters are circumferentially spaced around the bit body, the number of diamond cutters being an integral multiple of the number of cutters on the bit.

4. A rock bit as recited in claim 1 wherein such a diamond plate is circular.

5. A rock bit as recited in claim 1 wherein such a diamond plate is semi-circular and the straight edge of the diamond plate is substantially aligned with the longitudinal axis of the bit body.

6. A rock bit as recited in claim 1 wherein the straight edge of the diamond plate is tilted with respect to the longitudinal axis of the bit body at an angle of up to about 5° with the outermost portion of the straight edge being above the innermost portion.

7. A three cone rock bit for drilling oil wells or the like comprising:

a bit body having a longitudinal axis of rotation;

means at the upper end of the bit body for connecting the rock bit to a drill string;

three cutter cones mounted on the lower end of the bit body for rotation upon rotation of the bit body, each such cone comprising a plurality of tungsten carbide inserts protruding from the surface of the cone and including a gage row of such inserts for engaging the bottom of a hole being drilled adjacent the peripheral wall of the hole, the gage row inserts being arranged on the cutter cones for engaging the bottom of the hole substantially on the nominal gage diameter of the rock bit; and a plurality of diamond cutters protruding from a peripheral portion of the rock bit body at locations above the cones, each such diamond cutter comprising a diamond plate facing in a circumferential direction relative to the longitudinal axis of rotation of the bit body and having a cutting edge substantially on the nominal gage diameter of the rock bit for engaging the peripheral wall of the hole being drilled and maintaining the gage of the hole.

8. A rock bit as recited in claim 7 wherein the diamond plates are circular.

9. A rock bit as recited in claim 7 wherein each of the diamond plates is semi-circular.

10. A rock bit as recited in claim 9 wherein the straight edge of the semi-circular diamond plate is aligned with the longitudinal axis of the bit body.

11. A rock bit as recited in claim 10 wherein the straight edge of the diamond plate is tilted with respect to the longitudinal axis of the bit body at an angle of up to about 5° with the outermost portion of the straight edge being above the innermost portion.

* * * * *